US006092497A

United States Patent [19]

Preston et al.

[11] Patent Number: 6,092,497

[45] Date of Patent: Jul. 25, 2000

[54] ELECTROMECHANICAL LATCHING ROCKER ARM VALVE DEACTIVATOR

[75] Inventors: David M. Preston, Clarkston; Kynan L. Church, Ceresco; William C. Dumphy, Dearborn, all of Mich.

[73] Assignee: Eaton Corporation, Cleveland, Ohio

[21] Appl. No.: 09/256,272

[22] Filed: Feb. 23, 1999

[51] Int. Cl.[7] ..... F01L 13/00; F02D 13/06

[52] U.S. Cl. ..... 123/90.16; 123/198 F; 123/90.39

[58] Field of Search ..... 123/90.15, 90.16, 123/90.39, 90.48, 90.55, 198 F

[56] References Cited

U.S. PATENT DOCUMENTS

| | | | |
|---|---|---|---|
| 4,576,128 | 3/1986 | Nagahiro | 123/198 F |
| 5,549,081 | 8/1996 | Ohlendorf et al. | 123/90.16 |
| 5,592,907 | 1/1997 | Hasebe et al. | 123/90.16 |
| 5,613,469 | 3/1997 | Rygiel | 123/90.16 |
| 5,653,198 | 8/1997 | Diggs | 123/90.16 |
| 5,660,153 | 8/1997 | Hampton et al. | 123/90.16 |
| 5,697,333 | 12/1997 | Church et al. | 123/90.16 |
| 5,893,344 | 4/1999 | Church | 123/90.16 |
| 5,908,015 | 6/1999 | Kreuter | 123/90.16 |
| 5,924,396 | 7/1999 | Ochiai et al. | 123/90.16 |

*Primary Examiner*—Weilun Lo
*Attorney, Agent, or Firm*—L. J. Kasper

[57] ABSTRACT

A valve deactivator assembly (13) for an internal combustion engine, the assembly including a drive rocker arm (39) receiving cyclical motion from an engine push rod (23), and a driven rocker arm (41) which engages the engine poppet valve (29). The rocker arms are biased by a lost motion spring (49) to a position in which the rocker arms align to define a latching chamber (63), having a moveable latch member (65) disposed therein and biased by a spring (67) toward a latched position (FIG. 1). An electromagnetic actuator assembly (81) is disposed adjacent the rocker arms (39,41) and in response to an input signal (88), exerts a force on an actuation shaft (93) and an actuation beam (97) to move the latch member (65) toward its unlatched position (FIG. 3). The invention provides an effective, compact valve deactivator which can change quickly between the latched and unlatched conditions.

12 Claims, 4 Drawing Sheets

ELECTROMECHANICAL LATCHING ROCKER ARM VALVE DEACTIVATOR

CROSS-REFERENCE TO RELATED APPLICATIONS

Not Applicable

STATEMENT REGARDING FEDERALLY SPONSORED RESEARCH OR DEVELOPMENT

Not Applicable

MICROFICHE APPENDIX

Not Applicable

BACKGROUND OF THE INVENTION

The present invention relates to an improved valve train for an internal combustion engine, and more particularly, to a valve deactivator assembly for use therein.

Although the valve deactivator assembly of the present invention may be utilized to introduce some additional lash into the valve train, such that the valves open and close by an amount less than normal, the invention is especially suited for introducing into the valve train sufficient lash (also referred to hereinafter as "lost motion"), such that the valves no longer open and close at all, and the invention will be described in connection therewith.

Valve deactivators of the general type to which the invention relates are known, especially in connection with internal combustion engines having push rod type valve gear trains in which there is a rocker arm, with one end of the rocker arm engaging a push rod, and the other end engaging the engine poppet valve. Typically, a central portion of the rocker arm is fixed relative to the cylinder head (or other suitable structure) by a rocker shaft assembly, as is well known to those skilled in the art. In such an arrangement, the rocker shaft prevents any movement of the rocker arm except a pivotal movement, wherein the rocker arm engages in cyclical, pivotal movement, in response to the cyclical motion of the push rod, which results from the engagement of the push rod with the cam lobe of the rotating cam shaft.

In a rocker arm and rocker shaft type of valve gear train as described above, it is known to separate the rocker arm into two separate rocker arm portions, each of which is mounted for pivotal movement relative to the rocker shaft. U.S. Pat. Nos. 4,576,128; 5,592,907 and 5,613,469 all illustrate valve gear train of the type described, wherein the two rocker arm portions may be selectively latched or unlatched to achieve either normal engine valve opening and closing, or modified opening and closing, respectively. One of the types of modified valve operation known from the above-cited patents is a condition in which the lost motion introduced into the valve gear train is sufficient to effectively stop or "deactivate" the valves, i.e., the valves do not open and close at all when the rocker arm portions are unlatched.

Typically, the types of engine valve modification systems illustrated and described in the cited patents have their rocker arm latching mechanisms operate in response to hydraulic pressure. Although such systems may be generally satisfactory, in the sense of being able to achieve a modification in the opening and closing of the engine valves, the arrangements described have certain inherent disadvantages.

One disadvantage is that the hydraulic systems for operating the latching mechanisms, as shown in the cited patents, are such that the hydraulic system (e.g., having the rocker shaft define oil passages) must be designed into the engine when the engine is designed initially, in order for the engine design process to be cost effective, whereas it would be desirable to be able to add valve deactivator assemblies to an existing engine design.

Another disadvantage of the prior art systems relates to time of response. In modern internal combustion engines, utilizing fuel injection, it is especially desirable in a valve deactivation system to turn off the fuel injectors at the same time that the operation of the valves is stopped. However, the fuel injectors are electrically actuated, and can be turned off almost instantaneously, and therefore, it is desirable to be able to activate the valves and turn on the fuel injectors, or deactivate the valves and turn off the fuel injectors, within the ensuing, single revolution of the engine cam shaft. Such rapid control of the valve deactivator would be difficult with hydraulic control thereof, in view of the fact that hydraulic controls are affected by factors such as aeration of the engine oil, variations in oil viscosity with variations in temperature, and pressure variations as engine speed varies. Thus, and by way of example only, in developing the present invention, the goal for the valve deactivator system was a maximum time of about 25 milliseconds from "ON" to "OFF", or vice versa.

BRIEF SUMMARY OF THE INVENTION

Accordingly, it is an object of the present invention to provide an improved valve deactivator assembly which overcomes the above-described disadvantages of the prior art.

It is a more specific object of the present invention to provide an improved valve deactivator assembly, especially suited for push rod type valve gear train, which can be added to an existing engine design without the need for a major, fundamental redesign of the engine.

It is another object of the present invention to provide an improved valve deactivator system, wherein the valve deactivator involves relatively pivotable rocker arm portions, wherein a change between the latched and unlatched conditions can be achieved rapidly, using an electromagnetic actuator.

The above and other objects of the invention are accomplished by the provision of a valve deactivator assembly for an internal combustion engine of the type having valve means for controlling the flow to and from a combustion chamber, and drive means for providing cyclical motion for opening and closing the valve means in timed relationship to the events in the combustion chamber. The engine further includes valve gear means, operative in response to the cyclical motion, to effect cyclical opening and closing of the valve means. The valve gear means includes a rocker shaft and a rocker arm assembly mounted to be pivotable about the rocker shaft in response to the cyclical motion of the drive means. The rocker arm assembly includes a drive rocker arm and a driven rocker arm disposed axially adjacent each other, and each being pivotable about the rocker shaft.

The improved valve deactivator assembly is characterized by means for transmitting cyclical motion from the drive means to the drive rocker arm. The driven rocker arm is adapted to transmit the cyclical motion to the valve means. The drive and driven rocker arms cooperate to define a latch chamber, and a latch member is disposed in the latch chamber and includes means biasing the latch member toward a latched position, interconnecting the drive and driven rocker arms for pivotable movement in unison. An electromagnetic actuation means is included and is disposed adjacent the rocker arms and is operable in response to an electrical input signal to move the latch member toward an unlatched position, permitting pivotal movement of the drive rocker arm relative to the driven rocker arms.

DETAILED DESCRIPTION OF THE INVENTION

Figure 1:
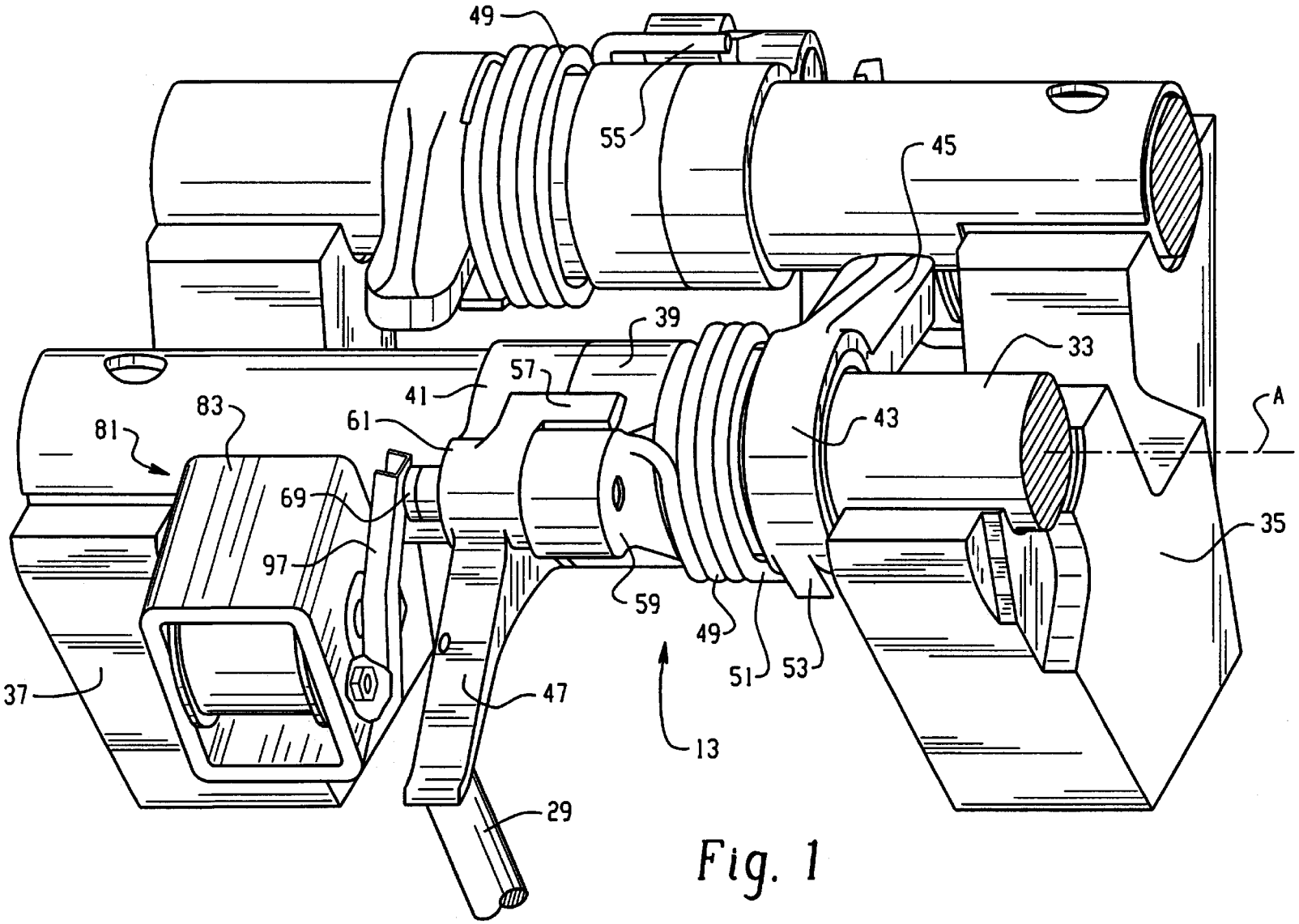
FIG. 1 is a fragmentary, perspective view illustrating a valve deactivator installation, including a pair of deactivator assemblies, for operating both an intake valve and an exhaust valve.
Figure 2:
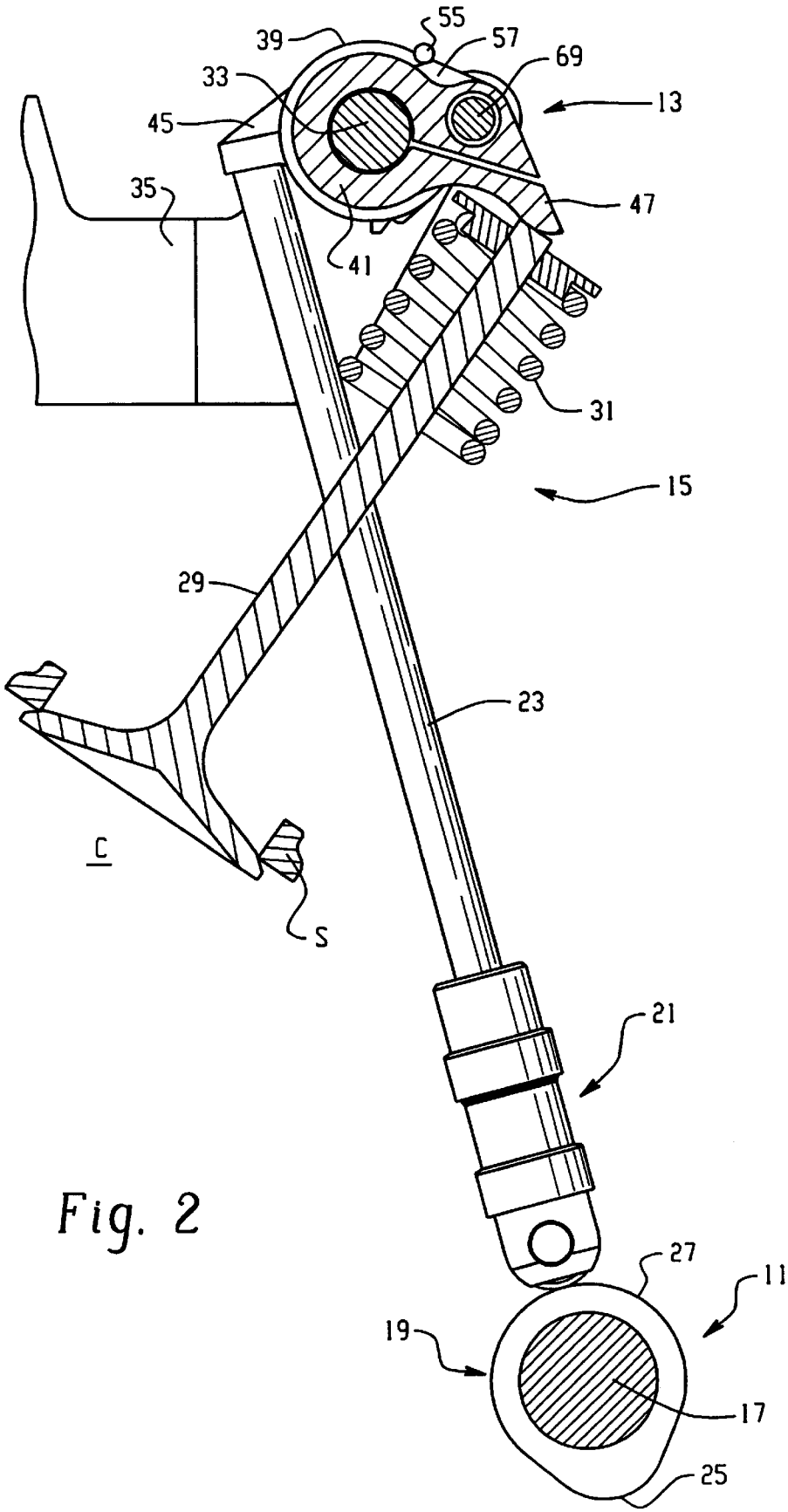
FIG. 2 is a fragmentary, cross-section, with various parts of the engine removed for ease of illustration, and taken through one of the rocker arms of the closer deactivator assembly in FIG. 1, and viewed from left to right in FIG. 1.

Referring now to the drawings, which are not intended to limit the invention, FIGS. 1 and 2 illustrate a valve actuating drive train of the push rod type, although it should be understood that the use of the present invention is not strictly limited to use in a push rod type engine. In FIGS. 1 and 2, and for simplicity of illustration, the engine block and the cylinder head have been omitted, although both the block and the head will be referenced in the subsequent description, simply as a point of reference, and not by way of limitation of the invention.

Disposed within the engine block is a drive assembly, generally designated 11, and disposed within the cylinder head is a rocker arm assembly 13 and an engine poppet valve assembly 15. The drive assembly 11 includes a cam shaft 17 having a cam 19, a hydraulic roller follower 21, and a push rod 23. Typically, the roller follower 21 would be disposed within a bore in the engine block, for reciprocation therein in response to the rotation of the cam 19. The cam 19 includes a lift portion 25 and a dwell (base circle) portion 27, as is well known to those skilled in the art.

The poppet valve assembly 15 includes an engine poppet valve 29, operable to control flow to and from a combustion chamber, generally designated C, and further includes a spring 31 which biases the poppet valve 29 toward a closed position in engagement with a valve seat S, as is also well known to those skilled in the art.

Referring now primarily to FIG. 1, the rocker arm assembly 13 is mounted on a rocker shaft 33, the opposite ends of which are supported by shaft support members 35 and 37. The shaft support members 35 and 37 are typically fixed relative to the cylinder head, or may be formed integrally therewith. It should be noted in FIG. 1 that the stem of the engine poppet valve 29 is shown, but with the spring 31 being removed, for ease of illustration.

Figure 3:
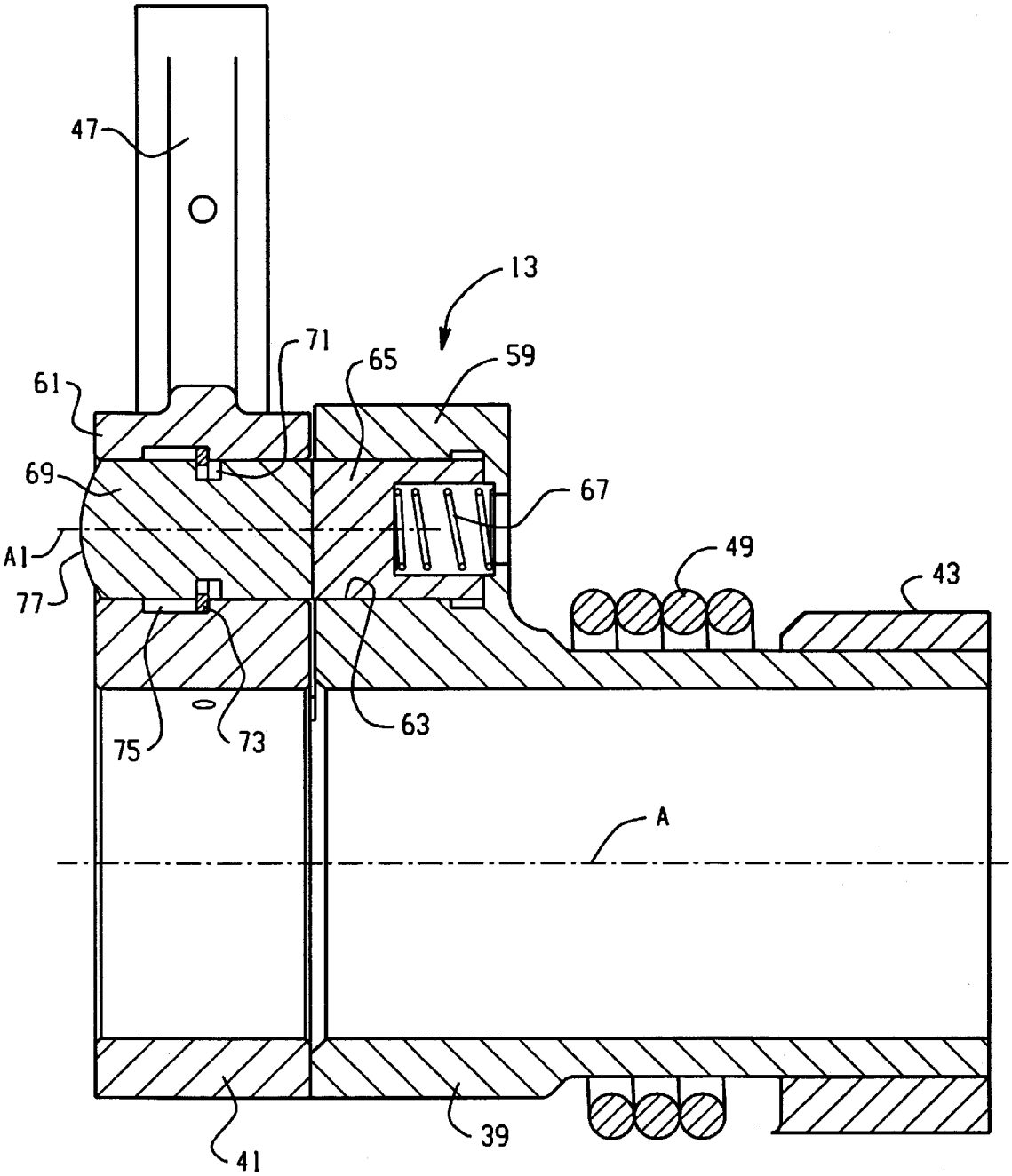
FIG. 3 is a generally horizontal cross-section, viewed upward in FIG. 1, but on a larger scale than FIG. 1, illustrating the rocker arm assembly of the present invention.

Referring now to FIG. 3, in conjunction with FIG. 1, the rocker arm assembly 13 includes an input or drive rocker arm 39 and an output or driven rocker arm 41. The drive rocker arm 39 includes a member 43 which is preferably pressed onto the push rod end (right end in FIGS. 1 and 3) of the drive rocker arm 39. The member 43 includes a generally radially extending portion 45 (shown only in FIGS. 1, 2 and 5) adapted to engage the upper end of the push rod 23. Thus, the cyclical motion imparted to the roller follower 21 and push rod 23 by the cam 19 is translated into a cyclical, pivotal movement of the drive rocker arm 39.

The driven rocker arm 41 includes a radially extending portion 47, the underside of which (shown in FIG. 3) is adapted for engagement with the upper end (tip portion) of the stem of the poppet valve 29.

Referring still primarily to FIGS. 1 and 3, the rocker arm assembly 13 includes a lost motion spring 49, most of which surrounds the main, cylindrical portion of the drive rocker arm 39 (as is best shown in FIG. 3). Thus, the member 43 is pressed onto the drive rocker arm 39 after the lost motion spring 49 is in place. The lost motion spring 49 includes an input end 51, extending generally parallel to an axis of rotation A of the rocker shaft 33. The input end 51 of the spring 49 is seated against a stop portion 53 (see FIG. 1). The lost motion spring 49 also includes an output end 55, which also extends axially, an output end 55 being seen best on the valve deactivator assembly in the background portion of FIG. 1. The driven rocker arm 41 includes a stop portion 57, to help insure that the output end 55 of the spring 49 remains in engagement with the surface of the driven rocker arm 41, as is shown in FIG. 2.

The drive and driven rocker arms 39 and 41 include boss portions 59 and 61, respectively (see also FIG. 5), which are preferably formed integrally with their respective rocker arms. The boss portions 59 and 61 cooperate to define a latch chamber 63 which, in the subject embodiment, is generally cylindrical, and defines an axis of rotation Al. Disposed within the latch chamber 63 is a cylindrical latch member 65, shown in FIG. 3 in the unlatched condition, fully retracted within the latch chamber 63 against the biasing force of a latch bias spring 67.

Also disposed within the latch chamber 63 is a generally cylindrical actuation member 69. The actuation member 69 defines an annular groove 71, and received within the groove 71 is a snap ring 73. The latch chamber 63 defines an axially extending annular groove 75, sized to receive the radially outer portion of the snap ring 73, thus permitting axial movement of the actuation member 69, but limiting such movement to the axial extent of the engagement of the snap ring 73 within the groove 75. Preferably, the actuation member 69 includes an engagement surface 77, shown in FIG. 3 as being generally concave, for reasons which will become apparent subsequently.

Figure 4:
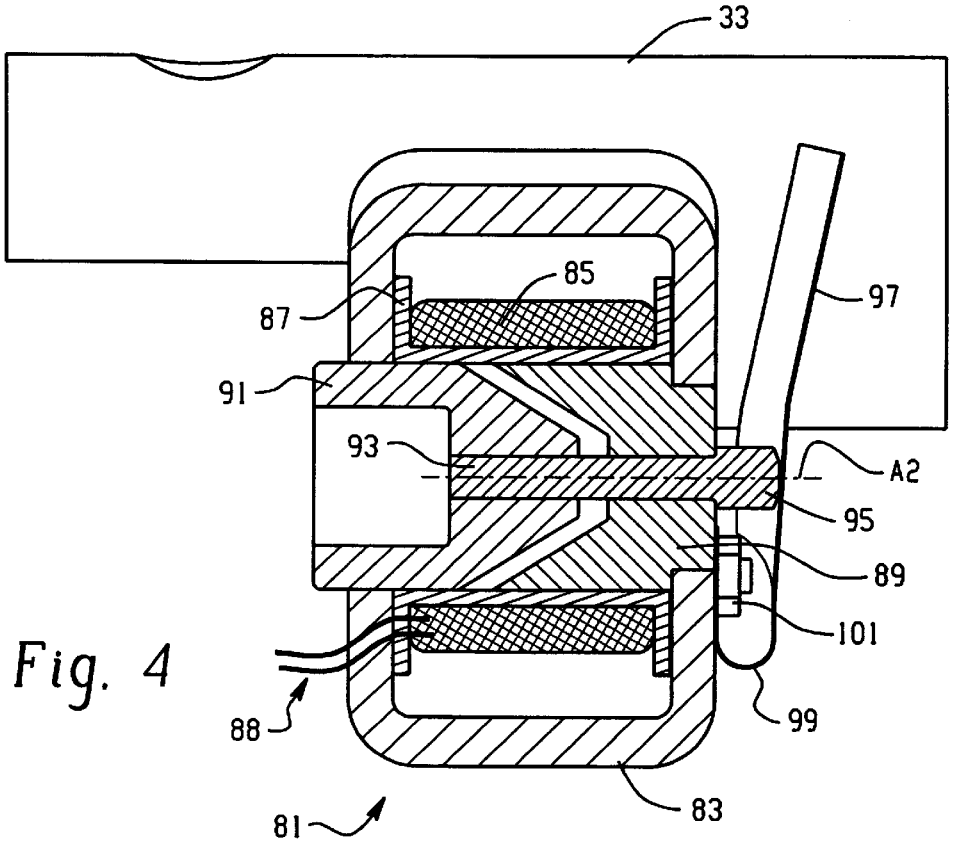
FIG. 4 is a generally vertical cross-section of the actuator which comprises part of the present invention.

Referring now primarily to FIG. 4, in conjunction with FIG. 1, there is illustrated an actuator assembly, generally designated 81. The actuator assembly 81 includes a generally rectangular housing member 83 which is preferably fixed in a stationary manner, such as by being attached to the adjacent shaft support member 37. The housing member 83 also serves the function of providing a flux path as will become apparent subsequently.

Disposed within the housing member 83 is an electromagnetic coil 85, wound about a support bobbin 87, the coil 85 being energized when it receives an appropriate electrical input signal by means of a pair of electrical leads 88, shown only schematically herein. The reference numeral "88" will also be used hereinafter for the electrical input signal itself. Disposed within the bobbin 87 is a fixed pole piece 89, which is attached to be stationary relative to the housing member 83. Also disposed within the bobbin 87 is a moveable pole piece 91, also typically referred to as an "armature". Fixed to the pole piece 91, and moveable therewith is an actuation shaft 93 which passes through a cylindrical opening in the fixed pole piece 89, and is in sliding engagement therewith. The actuation shaft 93 and the moveable pole piece define an axis of rotation A2, which will be referred to subsequently. An actuator head 95 is preferably formed integrally with the actuation shaft 93, and is disposed outside of the pole piece 89, the function of the actuator head 95 to be described subsequently.

Attached to the outside (right side in FIGS. 1 and 4) of the housing member 83 is an actuator beam 97 which may be viewed as an output member of the actuator assembly 81. Preferably, the actuator beam 97 is formed from spring steel and includes a lower, generally U-shaped spring portion 99. It is the left leg in FIG. 4 of the spring portion 99 which is anchored to the housing member 83, the attachment being shown herein as comprising a pair of threaded stud and nut assemblies 101 (see also FIG. 5). The actuator beam 97, above the U-shaped portion 99, is formed as a three-sided channel (see also FIG. 1). Thus, the actuator head 95 is received within the channel-shaped beam 97, and is able to transmit linear movement of the actuation shaft 93 into pivotal movement of the actuator beam 97. One important feature of the invention is that the actuator beam 97 results in a mechanical advantage in moving the actuation member 69. As the actuation shaft 93 moves to the right in FIG. 4, the upper end of the beam 97 moves a greater distance, linearly, than does the actuator head 95.

With the electromagnetic coil 85 de-energized, the spring portion 99 of the beam 97 biases the beam 97, the pole piece 91 and actuation shaft 93 to the de-activated position shown in FIG. 4. Whenever an appropriate electrical input signal 88 is transmitted to the coil 85, the lines of flux pass through the housing 83, the fixed pole piece 89 and the moveable pole piece 91, and bias the pole piece 91 and the actuation shaft 93 to the right in FIG. 4, against the biasing force of the spring portion 99, moving the actuator beam 97 to the right.

During normal operation, the actuator assembly 81 is de-energized, such that the actuator beam 97 is biased to the unactuated position shown in FIGS. 1 and 4, thus permitting the latch bias spring 67 to bias the latch member 65 and the actuation member 69 to the left in FIG. 3. With the latch member 65 and the actuation member 69 biased to the left, the engagement surface 77 remains in contact with the actuator beam 97 (as shown in FIG. 1). When the latch member 65 moves to the left in FIG. 3 under the influence of the spring 67, the latch member 65 is then in its latched condition interconnecting the boss portions 59 and 61, and therefore also fixing the drive and driven rocker arms 39 and 41 for pivotable movement in unison.

Therefore, with the rocker arm assembly 13 in the latched condition, cyclical motion of the push rod 23 in response to rotation of the cam 19 will cause pivotal movement of the rocker arms 39 and 41 about the rocker shaft 33, causing cyclical opening and closing of the poppet valve 29. In other words, in the latched condition, the operation of the valve gear train is the same as if the rocker arms 39 and 41 comprised a single, conventional rocker arm member.

When it becomes desirable to deactivate the poppet valve 29, an appropriate electrical signal 88 is transmitted to the electromagnetic coil 85. This is initiated while the roller follower 21 is in engagement with the base circle portion 27 of the cam 19 because, during the base circle portion of the valve event, the valve gear train is not under any substantial load. Therefore, it is in such an unloaded condition that it is desirable to change from the latched condition to the unlatched condition, or vice versa, for reasons which are well known to those skilled in the art. When the coil 85 is energized, the pole piece 91 and actuation shaft 93 move to the right, as described previously, biasing the actuator beam 97 to the right in FIG. 4. This rightward movement of the beam 97 overcomes the force of the latch bias spring 67 and moves the latch member 65 and actuation member 69 to the fully retracted, unlatched condition shown in FIG. 3. Preferably, this change from the latched condition to the unlatched condition is completed between the time that the roller follower 21 first engages the base circle portion 27 and the time the follower 21 begins to engage the lift portion 25. Once the drive rocker arm 39 is unlatched from the driven rocker arm 41, the cyclical motion of the push rod 23 will cause the drive rocker arm 39 to pivot about the rocker shaft 33. As the rocker arm 39 pivots (rotates clockwise in FIGS. 2 and 5) the lost motion spring 49 is "compressed", i.e., wound up about the drive rocker arm 39 because of the engagement of the stop portion 53 and the input end 51 of the spring 49. With the drive rocker arm 39 unlatched from the driven rocker arm 41, the boss portion 59 also moves clockwise (in FIG. 2) relative to the boss portion 61. However, the output end 55 of the spring 49 remains in engagement with the boss portion 61, which is not rotating, because it is now unlatched from the boss portion 59 (as shown in FIG. 3) and the biasing force of the spring 31, biasing the engine poppet valve 29 closed, is substantially greater than the biasing force of the lost motion spring 49. Preferably, the biasing force of the lost motion spring 49 is sufficient that, if the roller follower 21 includes a hydraulic lash compensation device, the spring 49 must be able to prevent the lash compensation device from "pumping up", i.e., extending more than is needed to compensate for lash in the valve gear train.

Therefore, with the drive and driven rocker arms 39 and 41 unlatched, the driven rocker arm 41 remains stationary, under the influence of the spring 31, and the poppet valve 29 remains closed. After each pivotal movement of the drive rocker arm 39, the boss portions 59 and 61 are returned to an aligned position, as shown in FIG. 3, because of the engagement of the boss portions with the output end 55 of the lost motion spring 49.

Figure 5:
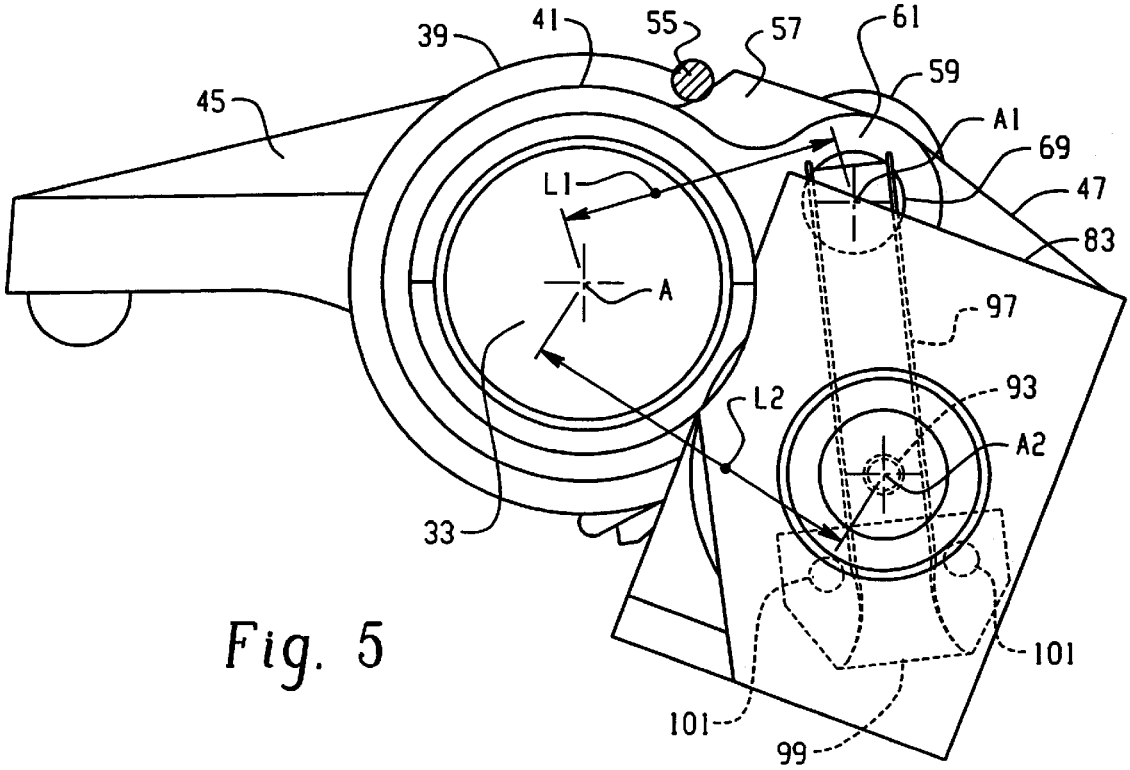
FIG. 5 is a somewhat schematic view, similar to FIG. 2, illustrating the spatial relationship of the various elements of the valve deactivator assembly of the present invention.

Referring now primarily to FIG. 5, it may be seen that the arrangement of the present invention provides a compact, effective package. In FIG. 5, the axis of rotation A1 of the latch chamber 63 is disposed at a distance L1 from the axis A of the rocker shaft 33, whereas the axis of rotation A2 of the actuation shaft 93 is disposed at a distance L2 from the axis A. It is desirable for the latch chamber 63 to be located as close as possible to the axis A of the rocker shaft 33, but the necessary size of the actuator assembly 81 requires that the axis A2 be further away from the axis A. For this reason, among others, direct electromagnetic actuation of the latching arrangement would not be feasible, but the "indirect" actuation of the present invention, by means of the actuation beam 97, enables each of the latch chamber 63 and the actuator assembly 81 to be mounted where necessary.

It may be seen that the present invention provides a substantially improved valve deactivator assembly which is compact and can be added to an existing design of a push rod and rocker shaft type engine. In a typical engine of that type, all that is required, by way of redesign of the engine, is to replace the existing rocker arm with the rocker arm assembly shown in FIG. 3, and mount the actuator assembly 81 shown in FIG. 4.

Although the invention has hereinabove been described with respect to the illustrated embodiments, it will be understood that the invention is capable of modification and variation and is limited only by the following claims.

We claim:

1. A valve deactivator assembly for an internal combustion engine of the type having valve means for controlling the flow to and from a combustion chamber, drive means for providing cyclical motion for opening and closing said valve means in timed relationship to the events in said combustion chamber and valve gear means, operative in response to said cyclical motion, to effect cyclical opening and closing of said valve means; said valve gear means including a rocker shaft and a rocker arm assembly mounted to be pivotable about said rocker shaft, in response to said cyclical motion of said drive means; said rocker arm assembly including a drive rocker arm and a driven rocker arm disposed axially adjacent each other, and each being pivotable about said rocker shaft; characterized by:

(a) means for transmitting said cyclical motion from said drive means to said drive rocker arm;

(b) said driven rocker arm being adapted to transmit said cyclical motion to said valve means;

(c) said drive and driven rocker arms cooperating to define a latch chamber;

(d) a latch member disposed in said latch chamber and including means biasing said latch member toward a latched position, interconnecting said drive and driven rocker arms for pivotable movement in unison;

(e) electromagnetic actuation means disposed adjacent said rocker arms and operable, in response to an electrical input signal to move said latch member toward an unlatched position permitting pivotal movement of said drive rocker arm relative to said driven rocker arm.

2. A valve deactivator assembly as claimed in claim 1, characterized by said drive means comprising a cam shaft having a cam defining a base circle portion and a lift portion.

3. A valve deactivator assembly as claimed in claim 2, characterized by said valve gear means comprises a cam follower in engagement with said cam and a push rod in operable engagement with said cam follower and with said drive rocker arm, said push rod comprising said means for transmitting said cyclical motion from said drive means.

4. A valve deactivator assembly as claimed in claim 3, characterized by said cam follower comprises a lash compensation element reciprocably disposed within said cam follower.

5. A valve deactivator assembly as claimed in claim 1, characterized by said latch chamber being generally cylindrical and defining a first axis oriented generally parallel to an axis defined by said rocker shaft.

6. A valve deactivator assembly as claimed in claim 5, characterized by an actuation member being disposed within said latch chamber and disposed axially between said latch member and an output member of said electromagnetic actuation means.

7. A valve deactivator assembly as claimed in claim 6, characterized by said actuation member including a terminal portion in engagement with said output member and disposed external to said latch chamber when said latch member is in said latched position.

8. A valve deactivator assembly as claimed in claim 5, characterized by said electromagnetic actuation means comprising a fixed pole piece, an electromagnetic coil, and an armature movable in response to changes in said electrical input signal, said armature defining a second axis oriented generally parallel to said axis of said rocker shaft.

9. A valve deactivator assembly as claimed in claim 8, characterized by said first axis being disposed at a first distance from said axis of said rocker shaft and said second axis being disposed at a second distance from said axis of said rocker shaft, said second distance being substantially greater than said first distance.

10. A valve deactivator assembly as claimed in claim 9, characterized by said electromagnetic actuation means including an output member operable to move said latch member, and operably associated with said armature, said output member being configured whereby movement of said armature over a first distance results in movement of said latch member over a second distance, said second distance being greater than said first distance.

11. A valve deactivator assembly as claimed in claim 4, characterized by a lost motion spring operably associated with said drive and driven rocker arms to bias said rocker arms toward a position relative to each other in which said rocker arms cooperate to define said latch chamber, said lost motion spring having sufficient biasing force to overload said lash compensation element.

12. A valve deactivator assembly as claimed in claim 11, characterized by said lost motion spring comprising a torsional spring member disposed in partially surrounding relationship to one of said drive and driven rocker arms, and including first and second ends, rotationally fixed relative to said drive and driven rocker arms, respectively.

* * * * *